US005329740A

United States Patent [19]

Hayashi et al.

[11] Patent Number: 5,329,740

[45] Date of Patent: Jul. 19, 1994

[54] CONCRETE REPAIRING AGENT INJECTION PLUG

[75] Inventors: Yuichiro Hayashi; Noboru Naito, both of Sakata, Japan

[73] Assignee: Nihon Mente Kaihatsu Kabushiki Kaisha, Yamagata, Japan

[21] Appl. No.: 949,986

[22] Filed: Sep. 24, 1992

[30] Foreign Application Priority Data

Oct. 2, 1991 [JP] Japan ..... 3-282263

[51] Int. Cl.[5] ..... E04G 23/02; E04B 1/41

[52] U.S. Cl. ..... 52/514; 52/704; 52/743; 52/744

[58] Field of Search ..... 52/743, 744, 704, 705, 52/125.5, 125.6, 514

[56] References Cited

U.S. PATENT DOCUMENTS

| | | | |
|---|---|---|---|
| 4,437,276 | 3/1984 | Goldberg | 52/125.5 |
| 4,749,170 | 6/1988 | Ase | 52/743 |
| 5,003,749 | 4/1991 | Harke | 52/704 |

FOREIGN PATENT DOCUMENTS

| | | | |
|---|---|---|---|
| 3426488 | 1/1986 | Fed. Rep. of Germany | 52/744 |

*Primary Examiner*—James L. Ridgill, Jr

*Attorney, Agent, or Firm*—Sughrue, Mion, Zinn, Macpeak & Seas

[57] ABSTRACT

A concrete repairing agent injection plug for injecting the concrete repairing agent into an injection groove formed in a concrete wall to be repaired, The injection plug and the injection groove provide sufficient fluid tightness regardless of surface irregularities of the wall adjacent or around the injection groove so as to avoid leakage of the repairing agent during injection work. A elastic member is provided which is partly or fully inserted into the injection groove. First and second pressure plates are provided for interposing therebetween the elastic member. Distance between the first and second pressure plates is changeable by a pressure mechanism. When the distance is reduced, the elastic member is compressed and is laterally expanded to brought into intimate contact with walls of the injection groove to thus close an open end portion of the groove. A concrete repairing agent injection pipe is detachably insertable into through holes arranged in line through the pressure members and the elastic member. Upon completion of the sealing to the injection groove by the elastic member, the repairing agent is injected into the groove through the injection pipe.

10 Claims, 7 Drawing Sheets

CONCRETE REPAIRING AGENT INJECTION PLUG

BACKGROUND OF THE INVENTION

The present invention relates to an injection plug for injecting a repairing agent into a concrete wall for its remedial purpose.

Degradation of concrete material of a concrete construction has been brought to attention. The degradation may be caused through various reasons. The degradation of the concrete may incur separation of a furring mortar formed over the concrete body. Such separation leads to falling of the skin members of a building, which may cause fatal accident for passersby. Accordingly, a proposal for a concrete wall repairing method is becoming a socially urgent matter.

The present inventors have proposed a novel method for injecting a concrete repairing agent, in which double concrete cutters are used for forming a circular injection groove having an approximately constant width, and a concrete repairing agent injection plug which practices the method. These proposals have been described in a copending U.S. patent application Ser. No. 07/714,943 filed Jun. 13, 1991.

The concrete repairing agent injection plug disclosed in the copending application is very effective when used to practice the above described injection method. However, the device has a packing surface which is depressed onto an outer wall surface portion surrounding the injection groove, and the packing is sealingly fixed at the portion for closing an opening end of the injection groove. The device may incur the following disadvantages:

When setting the injection plug over a coarse outer surface which is provided by spraying a mixture of coarse sands and a paint, it is necessary to enhance fluid-tightness between the packing surface and the outer wall surface, at which the open end of the injection groove is positioned. To this effect, the outer surface must be subjected to machining with an electric disc grinder or the like so as to provide a smooth surface of the outer wall in order to provide intimate contact between the wall surface and the packing surface.

If the injection plug is to be set on a locally irregular surface of the outer wall such as a joint lines of the tiles, it would be impossible to provide sufficient fluid tightness between the packing and the outer surface.

It would be rather difficult to fix the injection plug over a curved outer wall surface due to the configuration of the packing.

Residual injection material may be adhered and fixed at an inner wall surface of the injection plug and the packing. Thus, it would be troublesome to remove the residual injection material therefrom.

The residual material may be solidify at an injection nipple and close a fluid passage defined in the injection plug device. The removal work may be troublesome. Particularly, if a check valve is provided within the fluid passage, it would be very difficult to remove the solidified residual material therefrom.

SUMMARY OF THE INVENTION

The present invention has been made to overcome the above described drawbacks, and it is an object of the present invention to provide an improved concrete repairing agent injection plug device capable of providing a sufficient closure of an upper end of an injection groove so as to provide fluid-tightness relative to the injected space, to thus provide highly dense injection of the repairing agent into the defective portion of the concrete body.

Another object of the invention is to provide such injection plug device at low cost in which cleaning work for removing a residual repairing agent can be facilitated with saving a labor.

These and other objects of the present invention will be attained by providing a concrete repairing agent injection plug device for injecting repairing agent into an injection groove formed in a concrete construction wall, the injection plug device comprising an elastic member partly or fully insertable into the injection groove, a first pressure member, a second pressure member, a pipe member and a pressure mechanism. The first pressure member is positioned immediately above the elastic member. The second pressure member is positioned immediately below the elastic member for sandwiching the elastic member between the first and second pressure members. The first and second pressure members and the elastic member are formed with a through hole arranged in line. The pipe member is formed with a repairing agent injection passage and is detachably insertable into the through hole for injecting the repairing agent into a space of the injection groove. The pipe member has an outer portion protruding from the first pressure member and an inner end portion communicatable with the space of the injection groove. The pressure mechanism is connected to the first and second pressure members for reducing a distance therebetween so as to laterally expand the elastic member.

In the injection plug of the present invention, after a part of or entire elastic member is inserted into the injection groove, the distance between the first and second pressure members which sandwich the elastic member therebetween is reduced by the pressure mechanism. Therefore, the elastic member is compressed and is laterally expanded. Because of the lateral expansion of the elastic member, the elastic member is brought into intimate contact with walls of the injection groove. Thus, the injection groove is sealed. Accordingly, sufficient fluid tightness can be obtained regardless of the condition of the wall surface portion adjacent the injection groove.

Further, in the injection plug of the present invention, the concrete repairing agent injection pipe is detachably insertable into the through hole formed in the first and second pressure members and the elastic member. Therefore, when the injection work is finished, the injection pipe can be simply pulled out of the injection plug for scrapping. Accordingly, obviated can be an intricate work for removing the residual repairing agent affixed at the internal portion of the injection plug.

Further details of the present invention will become apparent from the description of the drawings and the preferred embodiments which follow.

DETAILED DESCRIPTION OF THE PREFERRED EMBODIMENTS

Figure 1:
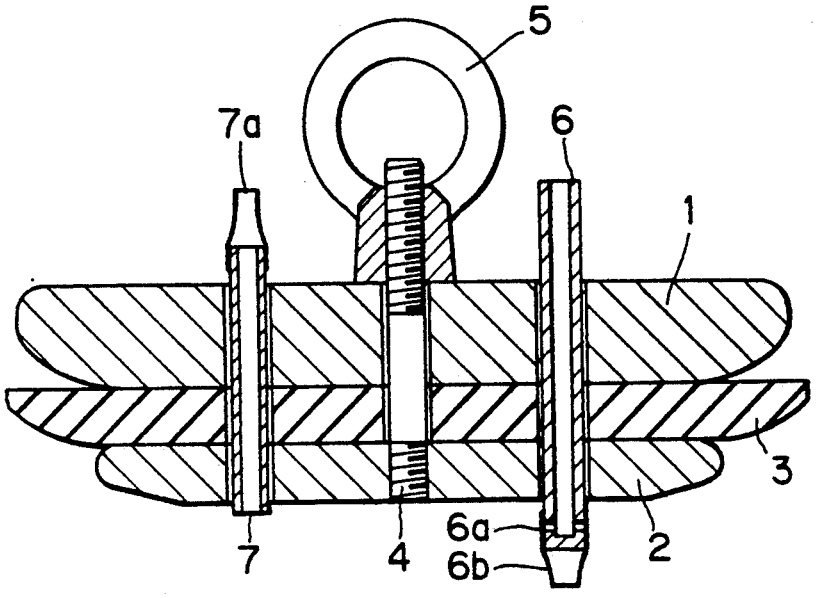
FIG. 1 is a cross-sectional side view showing a concrete repairing agent injection plug according to a first embodiment of the present invention.

A concrete repairing agent injection plug according to a first embodiment of the present invention will be described with reference to FIGS. 1 through 3.

In these Figures, there are shown a first pressure member 1, a second pressure member 2, an elastic member 3, a threaded rod 4, a nut 5, an injection pipe 6, an air discharge pipe 7, an outer mortar layer A, a concrete body layer B, a separation space layer C and a circular injection groove D.

The first and second pressure members 1 and 2 are made of a material having high strength and rigidity such as a metal. The elastic member is made of an elastic material having a suitable elasticity such as a urethane rubber. Central portions of the first and second pressure members 1 and 2 are formed with through holes having inner diameters approximately equal to each other. Further, a thread is formed at the through hole of the second pressure member 2. A thread is formed at a tip end portion and an outer peripheral surface of the threaded rod 4. After the threaded portion of the threaded rod 4 is threadingly engaged with the thread of the second pressure member 2, a root portion of the rod 4 extends through the through holes formed at the central portions of the first pressure member 1 and the elastic member 3. Further, a nut 5 is threadingly engaged with a second threaded portion formed at an outer or an another end portion of the rod 4. Thus, the elastic member 3 is sandwiched between the first and second pressure members 1 and 2.

The first and second pressure members 1 and 2 and the elastic member 3 are formed with a pair of through holes each extending in line at both sides of the central through holes. One of the through holes are inserted with a concrete repairing agent injection pipe 6, and the other through holes are inserted with the air discharge pipe 7. At a tip end portion of the injection pipe 6, a check valve mechanism which is similar to a valve used in a wheel of a bicycle is provided. That is, the tip end of the injection pipe 6 is closed by a blind member, and is formed with a plurality of radial small diameter bores 6*a* at a position behind the tip end portion, the bores being spaced away from one another by a circumferential distance. Further, a flexible elastic tube member 6*b* is provided at a tip end portion of the pipe 6 to cover but not seal the small diameter bores 6*a*. On the other hand, at an outer end portion of the air discharge pipe 7, a flexible elastic tube 7*a* is covered. A top end portion of the tube 7*a* is nipped by a clip (not shown) so as to close an air discharge pipe defined in the pipe 7.

The concrete repairing agent injection plug is used in the following manner.

1) The nut 5 is rotated in unfastening direction for moving the pressure members 1 and 2 away from each other. Thus, pressing force to the elastic member 3 is released. With this state, the air discharge pipe 7 and the injection pipe 4 are inserted into the right and left through holes, respectively.

Figure 2:
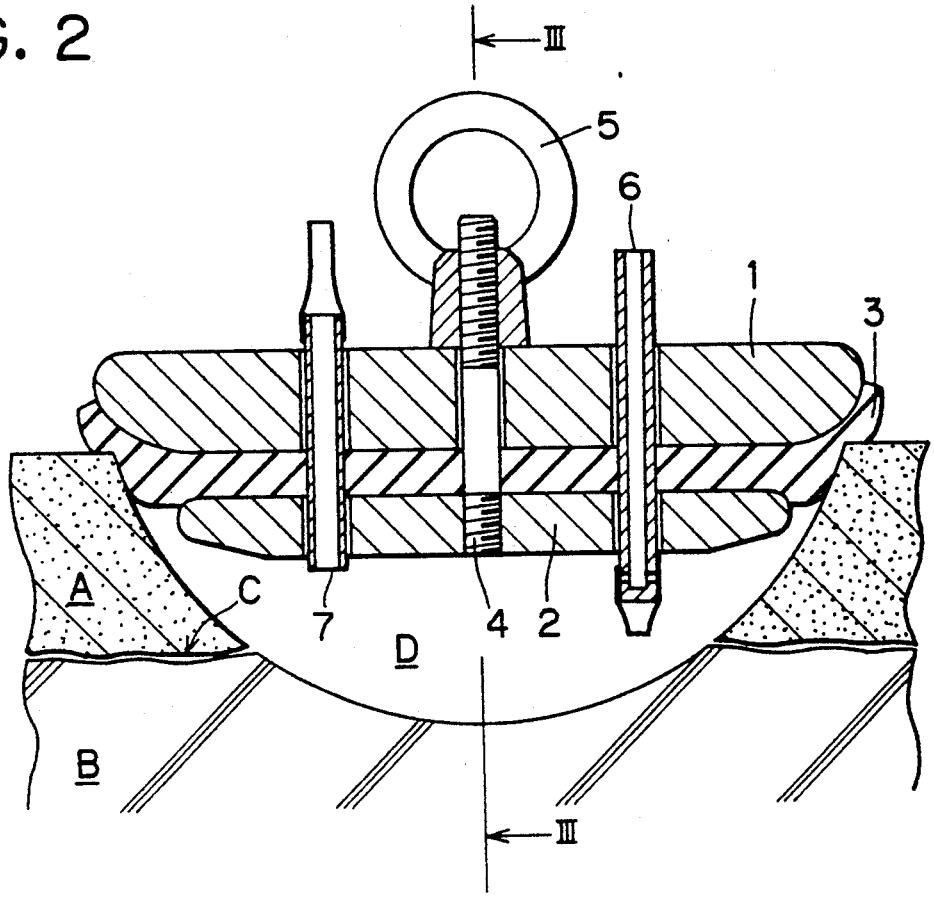
FIG. 2 is a cross-sectional side view showing the concrete repairing agent injection plug of the first embodiment set in conjunction with a circular groove formed in a concrete wall.
Figure 3:
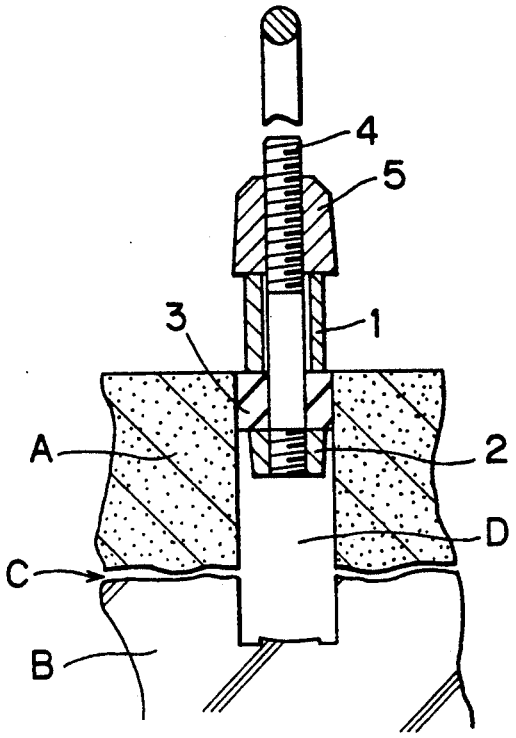
FIG. 3 is a transverse cross-sectional view taken along a line III—III which extends through a central threaded rod shown in FIG. 2 for showing a structure of the concrete repairing agent injection plug of the first embodiment.

2) As shown in FIG. 2, the injection plug is inserted into the circular injection groove D having an approximately constant width and circular depth, the groove being formed in the concrete wall by a conventional double blade type concrete cutter. The elastic member 3 is pressed into the injection groove D until an upper surface of the elastic member 3 becomes flush with the outer surface of the concrete wall. Incidentally, the concrete wall to be repaired includes the concrete body layer B and an outer mortar layer A covering the concrete body layer. The separation space layer C is provided therebetween which is formed by the degradation of the concrete body. The purpose of using the concrete repairing agent injection plug is to inject a concrete repairing agent such as a cement slurry and a mortar into the separation space layer C.

3) While the elastic member 3 of the injection plug is pressingly positioned in the injection groove D, the nut 5 is rotated in a fastening direction for moving the threaded rod 4, to thereby reduce the distance between the first and second pressure members 1 and 2. In accordance with the distance reduction, the elastic member 3 is compressed and is laterally expanded, so that the elastic member is brought into intimate contact with an inner surface of the injection groove D and outer peripheral surface of the injection pipe 6 and the air discharge pipe 7. Accordingly, high fluid sealability at the intimate contact portion can be provided.

4) The outer end portion of the injection pipe 6 is connected to an injection hose through a suitable connector for pressurizingly injecting the concrete repairing agent by a pump through the injection pipe 6. The injected concrete repairing agent is flowed into the injection groove D through fluid passages defined by the plurality of small diameter radial holes 6*a* formed at a position behind the tip end of the injection pipe 6 and by an inflation of the flexible tube 6*b*. In this case, air within the injection groove D and the separation space C can be discharged outside through the air discharge pipe 7. The injected repairing agent is filled in the injection groove D and the separation space layer C. When the injection is finished, the agent is leaked out of the outer end portion of the air discharge pipe 7. By this leakage, completion of injection work can be acknowledged. Then, the injection of the repairing agent is stopped, and an open end of the flexible tube 7*a* disposed over the outer end portion of the air discharge pipe 7 is closed by a suitable clip member so as to prevent the repairing agent from being further leaked.

5) If the concrete repairing agent injected by the process described in items (1) through (4), is solidified to some extent, the nut 5 is rotated in the unfastened direction, so that the elastic member 3 is laterally contracted because of its elasticity. Therefore, there is no intimate contact any more between the elastic member and the inner surface of the injection groove D. Subsequently, the injection plug is detached from the injection groove D to terminate the injection work of the concrete repairing agent.

Figure 4:
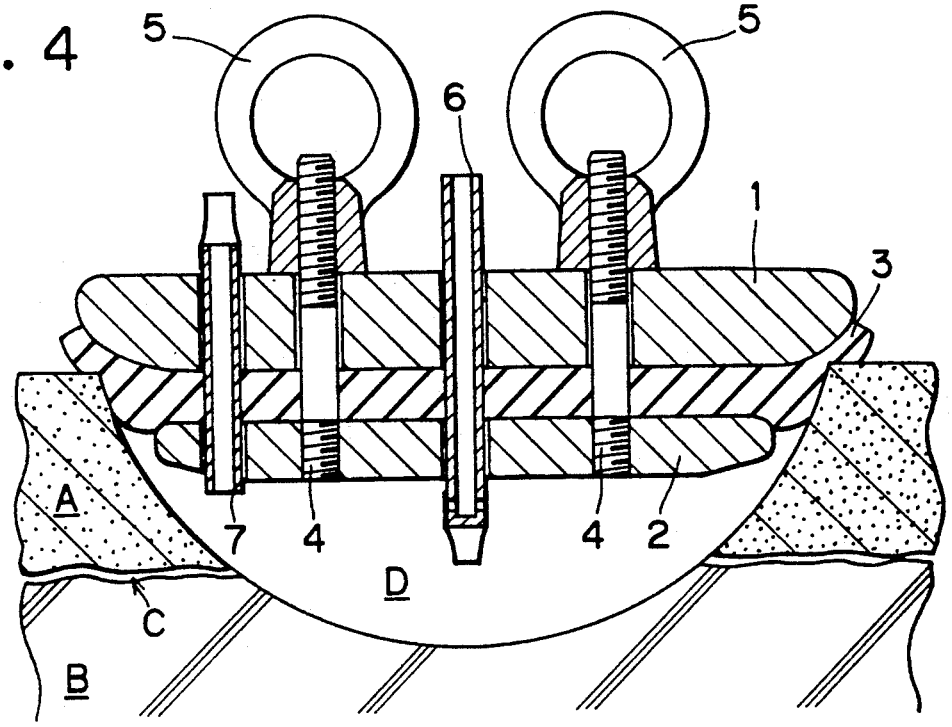
FIG. 4 is a cross-sectional side view showing a concrete repairing agent injection plug according to a second embodiment set in conjunction with a circular groove formed in a concrete wall.

A concrete repairing agent injection plug according a second embodiment of this invention will be described with reference to FIG. 4. In this Figure, like parts and components are designated by the same reference numerals as those shown in FIGS. 1 through 3 to avoid duplicating description. In the concrete repairing agent injection plug of the second embodiment, the injection pipe 6 is positioned at a central portion of the plug, and two threaded rods 4*a*, 4*b* are disposed at both sides of the injection pipe 6.

Figure 5:
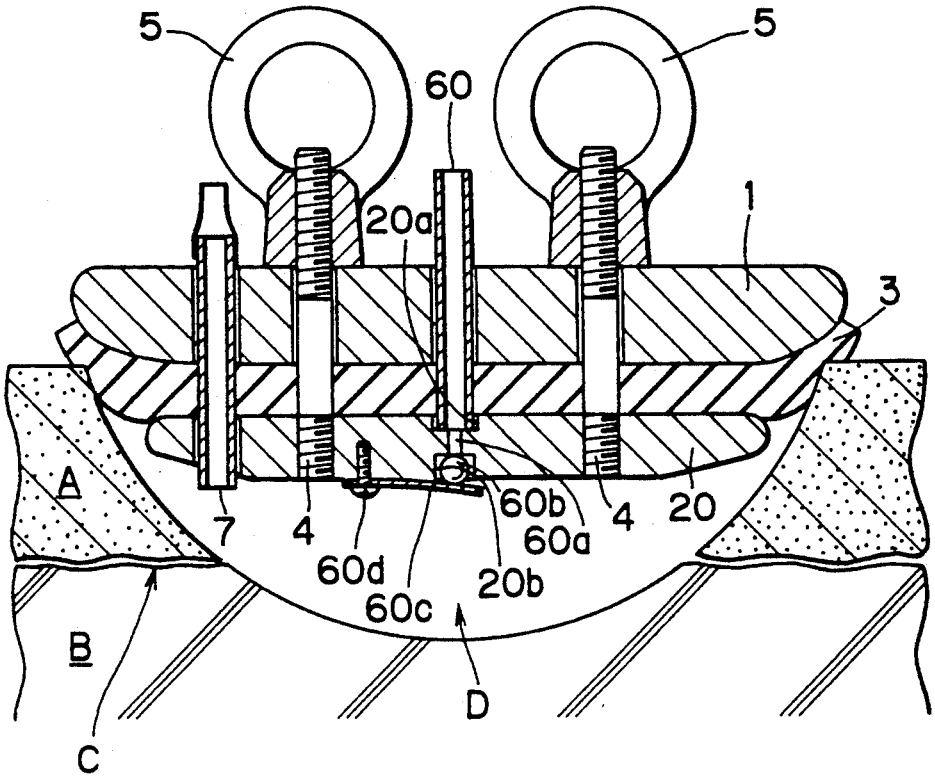
FIG. 5 is a cross-sectional side view showing a concrete repairing agent injection plug according to a third embodiment set in conjunction with a circular groove formed in a concrete wall.

A concrete repairing agent injection plug according to a third embodiment of this invention will be described with reference to FIGS. 5 and 6 wherein like parts and components are designated by the same reference numerals as those shown in FIGS. 1 through 4 to avoid duplicating description.

In the concrete repairing agent injection plug of the third embodiment, no check valve mechanism is provided in an injection pipe 60. Instead, the check valve mechanism is provided in the second pressure member 20. More specifically, at a central upper portion of the second pressure member 20, a large diameter recess 20*a* is formed for receiving a tip end portion of the injection pipe 60 which is inserted into the through holes formed in the first pressure member and the elastic member 3. At a central lower portion of the second pressure member 20, an accommodation pit 20*b* is formed for receiving therein a ball 60*b*. Further, a small diameter bore 60*a* is formed for communicating the large diameter recess 20*a* and the accommodation pit 20*b*. The ball 60*b* is urged toward the accommodation pit 20*b* by a leaf spring 60*c* so as to prevent the concrete repairing agent during injection from being reversely flowed. The leaf spring 60*c* is rotatably attached to the second pressure member 20 by an attachment bolt 60*d*.

Figure 6:
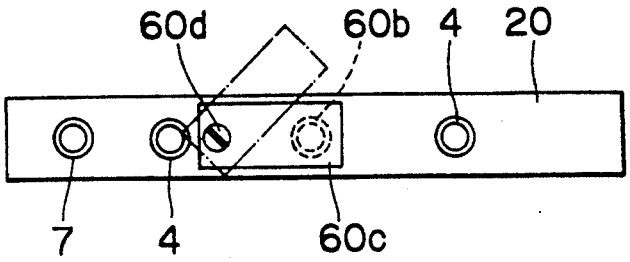
FIG. 6 is a bottom view showing a second pressure member of the injection plug shown in FIG. 5.

In case of removal work for removing the residual repairing agent, the leaf spring 60*c* is angularly rotated sidewardly as shown in FIG. 6 about an axis of the attachment bolt 60*d* so as to facilitate the detachment of the ball 60*b* from the accommodation pit 20*b*. Further, the injection pipe 60 is removed from the through hole. Here, the injection pipe 60 is a throwaway article, and can be prepared by cutting a widely available pipe into a predetermined length. Consequently, the entire cost of the injection plug can be advantageously reduced.

Figure 7:
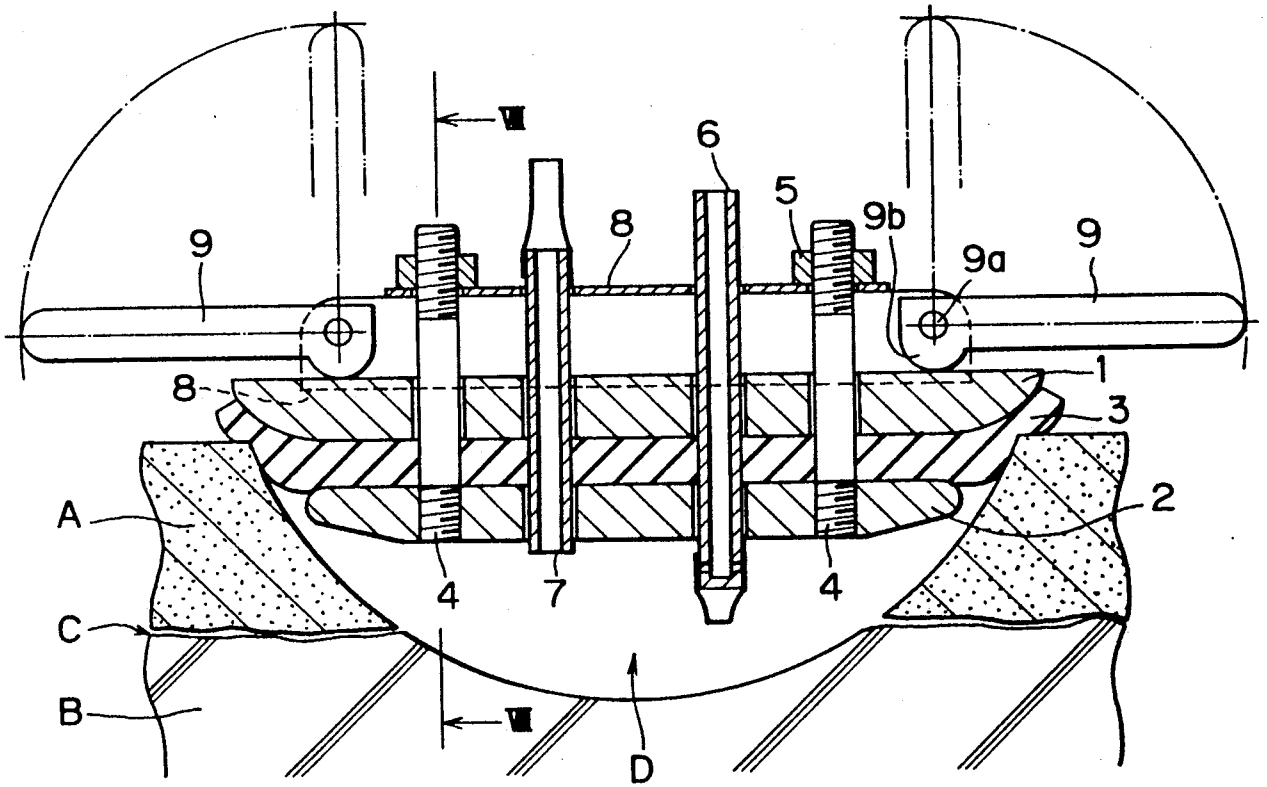
FIG. 7 is a cross-sectional side view showing a concrete repairing agent injection plug according to a fourth embodiment set in conjunction with a circular groove formed in a concrete wall.
Figure 8:
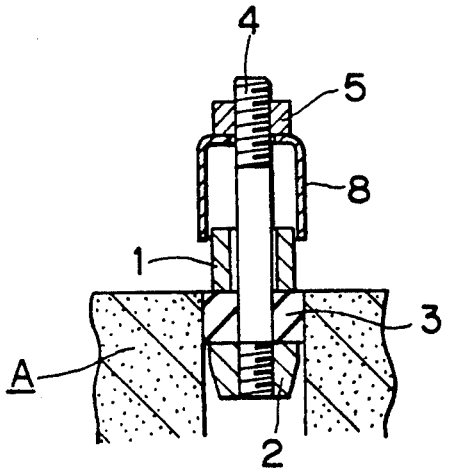
FIG. 8 is a transverse cross-sectional view taken along a line VIII—VIII which extends through a threaded rod of the injection plug shown in FIG. 7.

FIG. 7 is a cross-sectional side view showing a concrete repairing agent injection plug according to a fourth embodiment of this invention and an injection groove D in connection with the plug, and FIG. 8 is a lateral cross-sectional view taken along a line VIII—VIII extending through a center of a threaded rod shown in FIG. 7. In FIGS. 7 and 8, like parts and components are designated by the same reference numerals as those shown in FIGS. 1 through 6 to avoid duplicating description.

In the concrete repairing agent injection plug of the fourth embodiment, the injection pipe 6 and the air discharge pipe 7 are positioned between the threaded rods 4*a* and 4*b*. Further, the compression to the elastic member 3 is not made by the fastening of the nut 5 as seen in the first through third embodiments, but can be made by an angular pivotal movement of a cammed lever 9.

More specifically, an elongated member 8 is positioned between the nut 5 and the first pressure member 1. The elongated member has an upper horizontal bottom wall and two vertical side walls to provide a U-shape cross-section. A pair of support shafts 9*a*, 9*a* extend between the side walls, and one end of the cammed levers are pivotally connected to the elongated member 8 through the support shafts 9*a*. The pivot portion includes cam surfaces 9*b* whose radius is set larger than a normal distance between the upper bottom wall and the upper surface of the first pressure member 1.

With the structure, while the cammed lever 9 is vertically oriented, the upper bottom wall of the elongated member 8 and the upper surface of the pressure member 1 provides the normal distance therebetween. In this case, the injection plug device is inserted and depressed into the injection groove D so as to provide contact of the elastic member 3 with the injection groove D. Then, the cammed lever 9 is pivotally moved in a direction about an axis of the support shaft 9*a*. Therefore, the elongated member 8 and the pressure member 1 are moved away from each other at a great force established by the camed surface 9*b*. Thus, the elastic member 3 interposed between the pressure members 1 and 2 is compressed at a greater force and is expanded laterally, so that the injection plug can be firmly fixed to the injection groove D. In this embodiment, compression degree to the elastic member 3 is controllable by the rotation of the nut 5.

Figure 9:
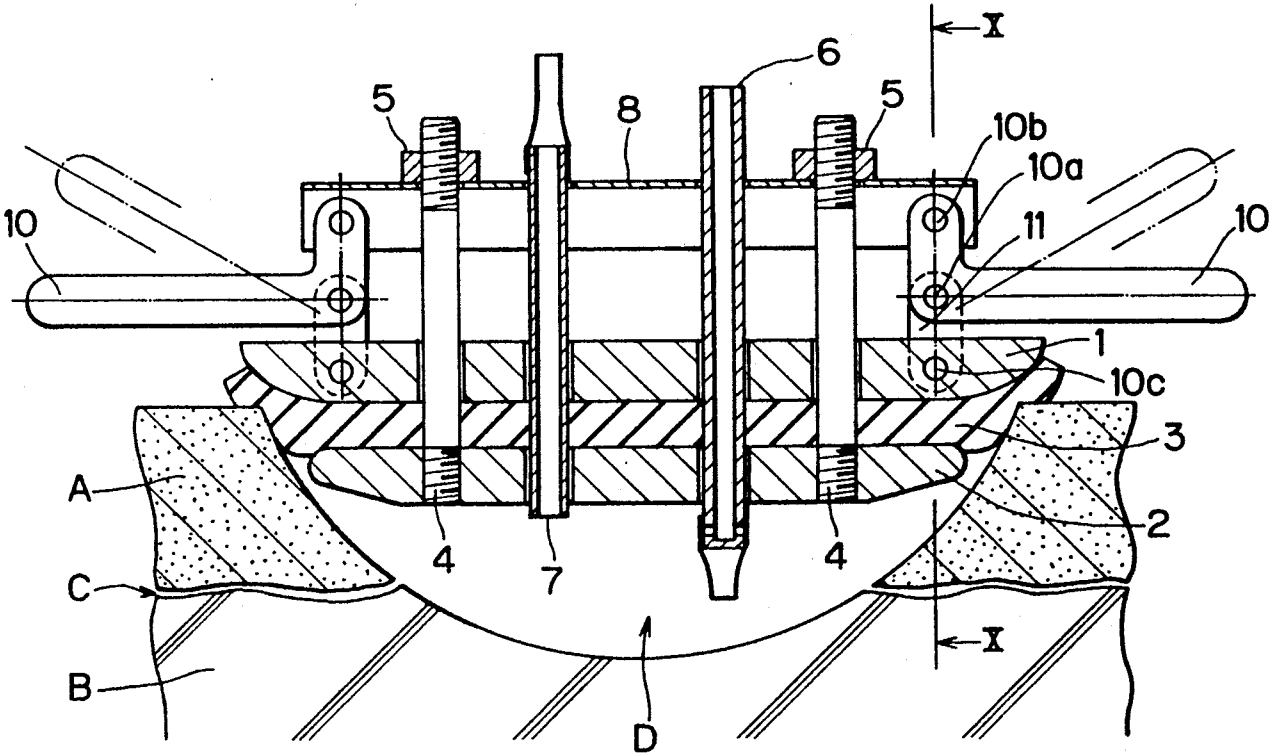
FIG. 9 is a cross-sectional side view showing a concrete repairing agent injection plug according to a fifth embodiment set in conjunction with a circular groove formed in a concrete wall.
Figure 10:
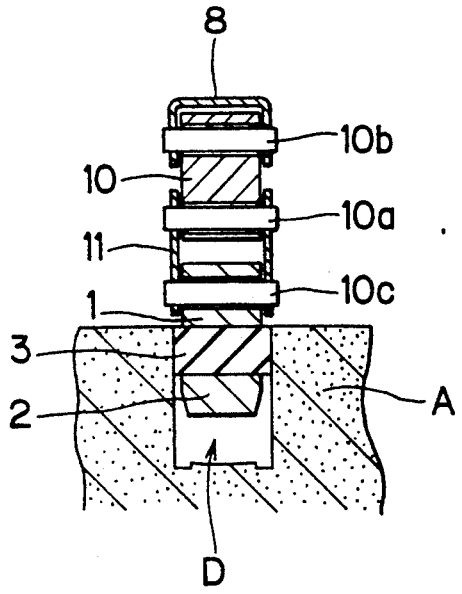
FIG. 10 is a transverse cross-sectional view taken along a line X—X shown in FIG. 9.

FIG. 9 is a cross-sectional side view showing a concrete repairing agent injection plug according to a fifth embodiment of this invention and an injection groove D in connection with the plug, and FIG. 10 is a cross-sectional view showing a toggle joint mechanism shown in FIG. 9. In FIGS. 9 and 10, like parts and components are designated by the same reference numerals as those shown in FIGS. 1 through 8 to avoid duplicating description.

The plug device of the illustrated embodiment employs a compression mechanism using a toggle joint instead of the above described compression mechanism for compressing the elastic member 3. The toggle joint mechanism includes a L-shaped lever 10, a link 11 and shafts 10*a*, 10*b* and 10*c*. The L-shaped member 10 has an end portion pivotally supported to the vertical side walls of the elongated member 8 by means of a shaft 10*b*. The L-shaped lever 10 has an angled portion and an arm portion. The angled portion is pivotally connected to one end portion of a link 11 through the shaft 10*a*. The link 11 has another end portion pivotally connected to the first pressure member 1 by the shaft 10*c*.

By pivotally moving the L-shaped lever 10 about the shaft 10*b*, the elongated member 8 and the pressure member 1 are moved away from each other at a great force. Therefore, the elastic member 3 interposed between the pressure members 1 and 2 are compressed at a great force to be expanded laterally, so that the injection plug can be firmly fixed to the injection groove D.

In the above described embodiments, the air discharge pipe is provided. However, the air discharge pipe can be dispensed with. Further, in the illustrated embodiment, a length of the elastic member is slightly larger than a length of the open end of the circular injection groove D, so that both ends of the elastic member is bulged from the injection groove D. However, the length of the elastic member can be approximately equal to the open end length of the injection groove, so that the both ends of the elastic member can be completely inserted into the injection groove.

Furthermore, in the above described embodiments, the check valve mechanism is provided at the injection pipe 6 or 60. However, the mechanism can be dispensed with. In the latter case, injection of the concrete repairing agent is suspended, and the outer end portion of the injection pipe disconnected from the injection hose should be closed by a suitable plug or lid member.

As described above, in the concrete repairing agent injection plug device according to the present invention, after a part of or entire elastic member such as a rubber is inserted into the open end portion of the injection groove, the elastic member is laterally expanded by reducing the distance between the first and second pressure members which interpose therebetween the elastic member by means of the pressure mechanism. Therefore, the upper portion of the injection groove can be sealed by the laterally expanded elastic member. Consequently, sufficient fluid tightness can be obtained regardless of the wall surface condition adjacent the injection groove.

Further, the injection plug of this invention is provided with the concrete repairing agent injection pipe insertable relative to the through holes arranged in line in the first and second pressure members and the elastic member. Therefore, upon completion of the injection work, the injection pipe can be simply detached from the injection plug for scrapping. Accordingly, obviated can be the intricate removal work for removing residual repairing agent solidified in the internal portion of the injection plug.

The injection pipe 6(60) and the air discharge pipe 7 can be of cartridge type throwaway articles. In particular, in the third embodiment, ordinary rigid resin pipe can be used by cutting the same into a proper length. As a result, cost of the expendable can be greatly reduced, which leads to reduction in entire cost for the work. Moreover, since it is unnecessary to conduct removal work for removing the residual repairing agent, entire labor can be reduced.

While the invention has been described in detail and with reference to specific embodiment thereof, it would be apparent to those skilled in the art that various changes and modifications may be made therein without departing from the spirit and scope of the invention.

What is claimed is:

1. A concrete repairing agent injection plug device for injecting the repairing agent into an injection groove whose cross-section is arcuate formed in a concrete construction wall, the injection plug device comprising:

an elastic member partly or fully insertable into the injection groove;

a first pressure member positioned immediately above the elastic member;

a second pressure member positioned immediately below the elastic member, said second pressure member having an elongated plate shape, for sandwiching the elastic member between the first and second pressure members, the first and second pressure members and the elastic member being formed with a through hold arranged in line;

a pipe member formed with a repairing agent injection passage and detachably insertable into the through hole for injecting the repairing agent into a space of the injection groove, the pipe member having an outer portion protruding from the first pressure member and an inner end portion communicatable with the space of the injection groove; and a pressure mechanism connected to the first and second pressure members for reducing a distance therebetween so as to laterally expand the elastic member.

2. The injection plug device as claimed in claim 1 further comprising a check valve mechanism positioned at an inner end portion of the pipe member.

3. The injection plug device as claimed in claim 1, wherein a second through hole is formed in line in the first and second pressure members and the elastic member interposed therebetween, and the device further comprising an air discharge pipe detachably insertable into the second through hole.

4. The injection plug device as claimed in claim 3, further comprising a check valve mechanism positioned at an inner end portion of the pipe member.

5. The injection plug device as claimed in claim 4, wherein the check valve mechanism comprises:

radial passage means provided at the inner end portion of the pipe member and in communication with the injection passage; and a tubular elastic member disposed to cover the radial passage means.

6. The injection plug device as claimed in claim 1, wherein the pressure mechanism comprises:

a rod member extending through the first and second pressure members and the elastic member, the rod member having an inner end portion threadingly engageable with the second pressure member and an outer end formed with a thread and projecting from the first pressure member;

a nut member threadingly engageable with the thread, distance between the first and the second pressure members being reduced by a threading rotation of the nut.

7. The injection plug device as claimed in claim 6 further comprising a check valve mechanism positioned at an inner end portion of the pipe member.

8. The injection plug device as claimed in claim 6 wherein a second through hole is formed in line in the first and second pressure members and the elastic member interposed therebetween, and the device further comprising an air discharge pipe detachably insertable into the second through hole.

9. The injection plug device as claimed in claim 8, further comprising a check valve mechanism positioned at an inner end portion of the pipe member.

10. The injection plug device as claimed in claim 9, wherein the check valve mechanism comprises:

radial passage means provided at the inner end portion of the pipe member and in communication with the injection passage; and a tubular rubber member disposed to cover the radial passage means.

* * * * *